US010779643B2

(12) United States Patent
Knutson et al.

(10) Patent No.: US 10,779,643 B2
(45) Date of Patent: Sep. 22, 2020

(54) CABINET SYSTEM AND METHOD FOR ASSEMBLING A CABINET SYSTEM

(71) Applicant: SPG INTERNATIONAL LLC, Covington, GA (US)

(72) Inventors: James Knutson, McDonough, GA (US); Bobby L. Salter, Lochbuie, CO (US); Arturo Gonzalez, Lilburn, GA (US); Shawn Irons, Lithonia, GA (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 16/327,243

(22) PCT Filed: Aug. 29, 2017

(86) PCT No.: PCT/US2017/049149
§ 371 (c)(1),
(2) Date: Feb. 21, 2019

(87) PCT Pub. No.: WO2018/044907
PCT Pub. Date: Mar. 8, 2018

(65) Prior Publication Data

US 2019/0223592 A1 Jul. 25, 2019

Related U.S. Application Data

(60) Provisional application No. 62/382,105, filed on Aug. 31, 2016.

(51) Int. Cl.
*A47B 47/02* (2006.01)
*A47B 77/02* (2006.01)
(Continued)

(52) U.S. Cl.
CPC ..... *A47B 47/024* (2013.01); *A47B 47/0083* (2013.01); *A47B 47/03* (2013.01);
(Continued)

(58) Field of Classification Search
CPC ..... A47B 47/024; A47B 47/0025; A47B 47/0033; A47B 47/0083; A47B 47/0091;
(Continued)

(56) References Cited

U.S. PATENT DOCUMENTS 2,620,251 A 12/1952 Restivo
3,879,096 A 4/1975 Blodee
(Continued)

FOREIGN PATENT DOCUMENTS

EP 1029470 A1 8/2000
FR 2305630 A2 10/1976
GB 2032037 A * 4/1980 ..... A47B 47/03

OTHER PUBLICATIONS

International Search Report and Written Opinion for Application No. PCT/US2017/049149 dated Nov. 16, 2017 (8 pages).
Extended European Search Report from the European Patent Office for Application No. 17847377.3 dated Dec. 1, 2019 (7 pages).

*Primary Examiner* — Daniel J Rohrhoff
(74) *Attorney, Agent, or Firm* — Michael Best & Friedrich LLP

(57) ABSTRACT

A cabinet system includes a frame at least partially defined by a plurality of vertical legs and a shelf defining a first plane and supported by the plurality of vertical legs. The vertical legs extend transverse to the first plane. A countertop is supported by the plurality of vertical legs. A body panel is coupled to the frame and has a plurality of apertures. A door is coupled to the frame and operable to selectively provide access to the shelf. The door has a plurality of apertures. Posts are coupled to the frame and extend transverse to the first plane. Each post of the plurality of posts is configured to extend through (i) an associated aperture of the plurality of apertures in the body panel to couple the body panel to the frame or through (ii) an associated aperture of the plurality of apertures in the door to couple the door to the frame.

22 Claims, 8 Drawing Sheets

(51) Int. Cl.

| | |
|---|---|
| ***A47B 47/00*** | (2006.01) |
| ***A47B 47/03*** | (2006.01) |
| ***A47B 57/26*** | (2006.01) |
| ***A47B 57/54*** | (2006.01) |
| ***A47B 96/02*** | (2006.01) |

(52) U.S. Cl.
CPC ..... *A47B 57/265* (2013.01); *A47B 57/545* (2013.01); *A47B 77/02* (2013.01); *A47B 96/021* (2013.01)

(58) Field of Classification Search
CPC ..... A47B 47/021; A47B 47/03; A47B 47/027; A47B 47/045; A47B 47/047; A47B 47/05; A47B 57/562
See application file for complete search history.

(56) References Cited

U.S. PATENT DOCUMENTS

| | | | | |
|---|---|---|---|---|
| 5,150,500 | A | 9/1992 | Bisbing | |
| 6,419,330 | B1 | 7/2002 | Lechman | |
| 9,169,679 | B2 * | 10/2015 | McAdoo | E05D 7/105 |
| 2005/0127802 | A1 * | 6/2005 | Chen | A47B 57/36 312/265.4 |
| 2008/0272676 | A1 * | 11/2008 | Eustace | A47B 47/0083 312/243 |
| 2010/0079042 | A1 * | 4/2010 | Eilers | A47B 47/0008 312/107 |

* cited by examiner

CABINET SYSTEM AND METHOD FOR ASSEMBLING A CABINET SYSTEM

CROSS-REFERENCE TO RELATED APPLICATIONS

This application claims priority to PCT Application No. PCT/US2017/049149 filed Aug. 29, 2017 and U.S. Provisional Patent Application No. 62/382,105, filed Aug. 31, 2016, the entire contents of which are incorporated by reference herein.

BACKGROUND

The present disclosure relates to cabinet systems, and more particularly to components of modular cabinet systems and methods for assembling and disassembling such cabinet systems.

SUMMARY

A cabinet system includes a frame at least partially defined by a plurality of vertical legs and a shelf defining a first plane and supported by the plurality of vertical legs. The legs extend transverse to the first plane. A countertop is supported by the plurality of vertical legs. A body panel is coupled to the frame and a door is coupled to the frame and operable to selectively provide access to the shelf. Posts are fastened to the frame and extend transverse to the first plane. The body panel and the door are coupled to the frame via the plurality of posts.

A cabinet system includes a frame having a plurality of frame members securable to one another and first and second mounting brackets, each of which is removably couplable to one of the frame members and presents an extension. A panel is configured for attachment to the frame via the extension of the first mounting bracket and the extension of the second mounting bracket.

A cabinet system includes a frame at least partially defined by a plurality of vertical legs and a shelf defining a first plane and supported by the plurality of vertical legs. The vertical legs extend transverse to the first plane. A countertop is supported by the plurality of vertical legs. A body panel is coupled to the frame and has a plurality of apertures. A door is coupled to the frame and operable to selectively provide access to the shelf. The door has a plurality of apertures. Posts are coupled to the frame and extend transverse to the first plane. Each post of the plurality of posts is configured to extend through (i) an associated aperture of the plurality of apertures in the body panel to couple the body panel to the frame or through (ii) an associated aperture of the plurality of apertures in the door to couple the door to the frame.

A cabinet system includes a frame having a plurality of frame members securable to one another and first and second mounting brackets, each of which is configured to removably couple to one of the frame members. Each of the first and second mounting brackets includes a post. A panel has a first aperture and a second aperture. The post of the first mounting bracket is configured to extend through the first aperture and the post of the second mounting bracket is configured to extend through the second aperture to couple the panel to the frame.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

DETAILED DESCRIPTION

Figure 1:
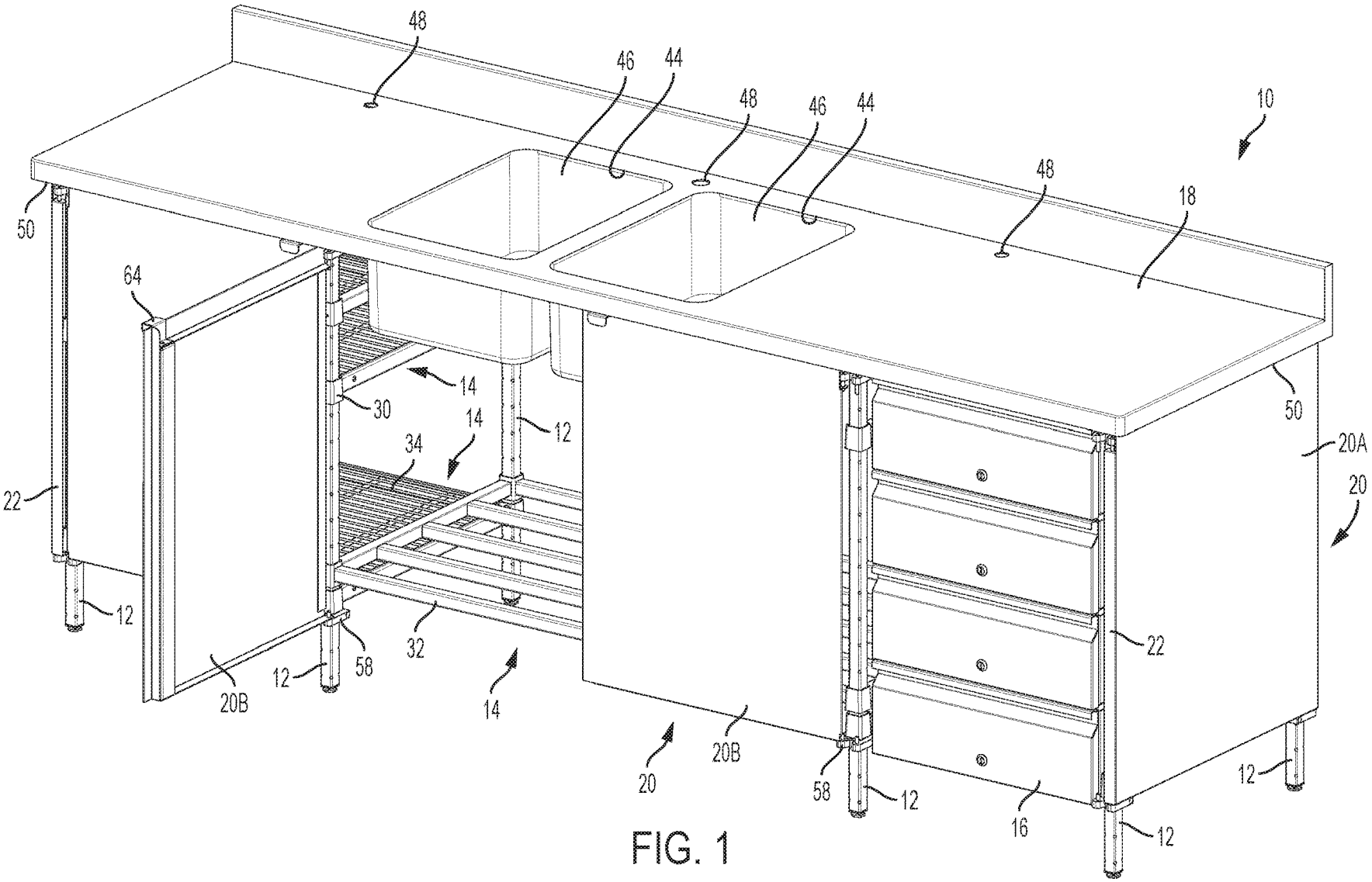
FIG. 1 is a perspective view of a cabinet system.

Referring to FIG. 1, a cabinet system 10 includes a plurality of support beams or legs 12, shelves 14, drawers 16, panels 20A, 20B, and a countertop 18. Collectively, the legs 12 and shelves 14, in addition to connectors 30 and crossbeams 38, form a frame 74. Although shown as a floor-mounted base kitchen cabinet system, the cabinet system 10 may alternatively be a non-floor mounted cabinet system, such as a wall-mounted cabinet system.

Figure 2A:
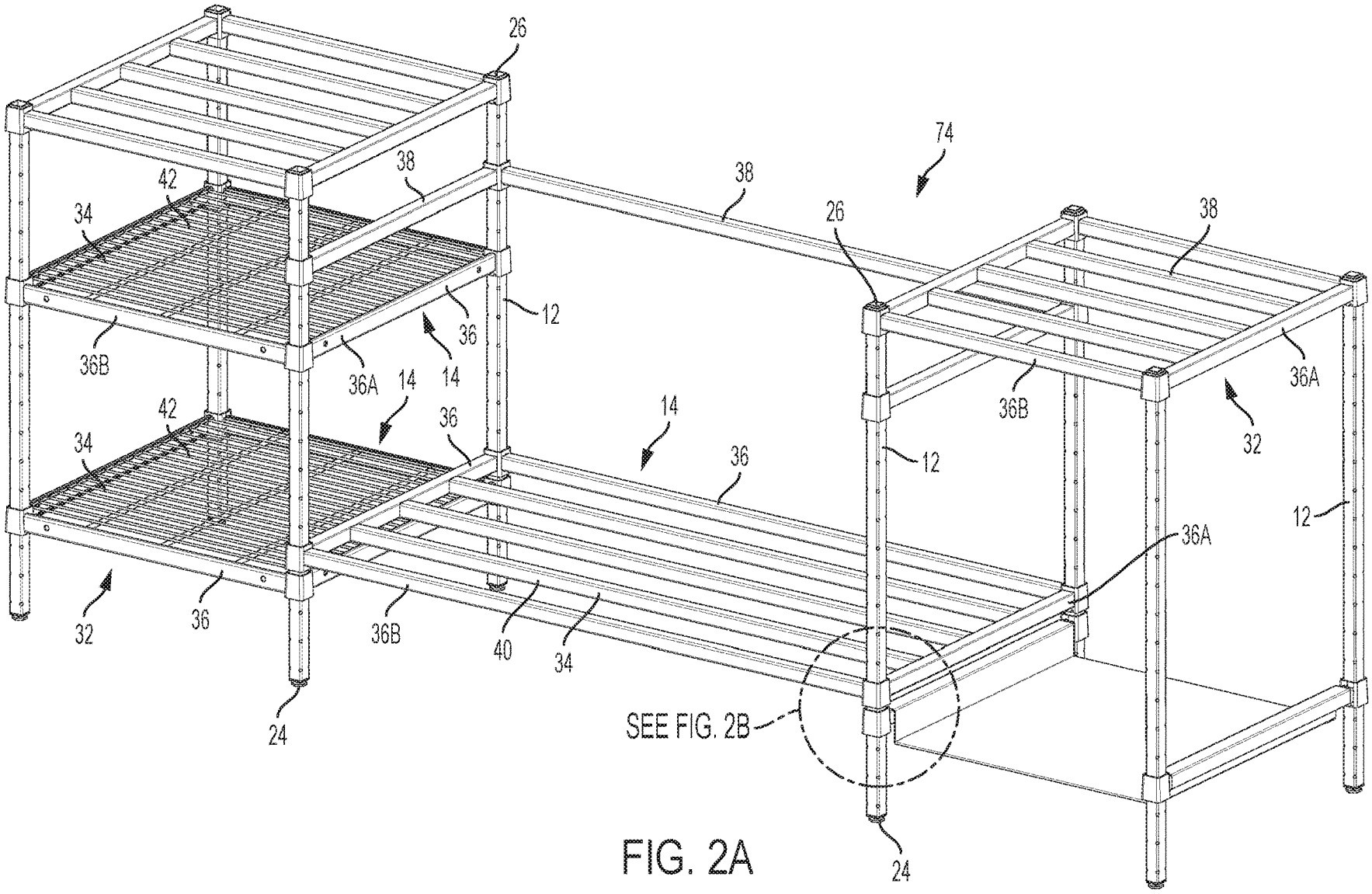
FIG. 2A is a perspective view of a frame of the cabinet system of FIG. 1.
Figure 2B:
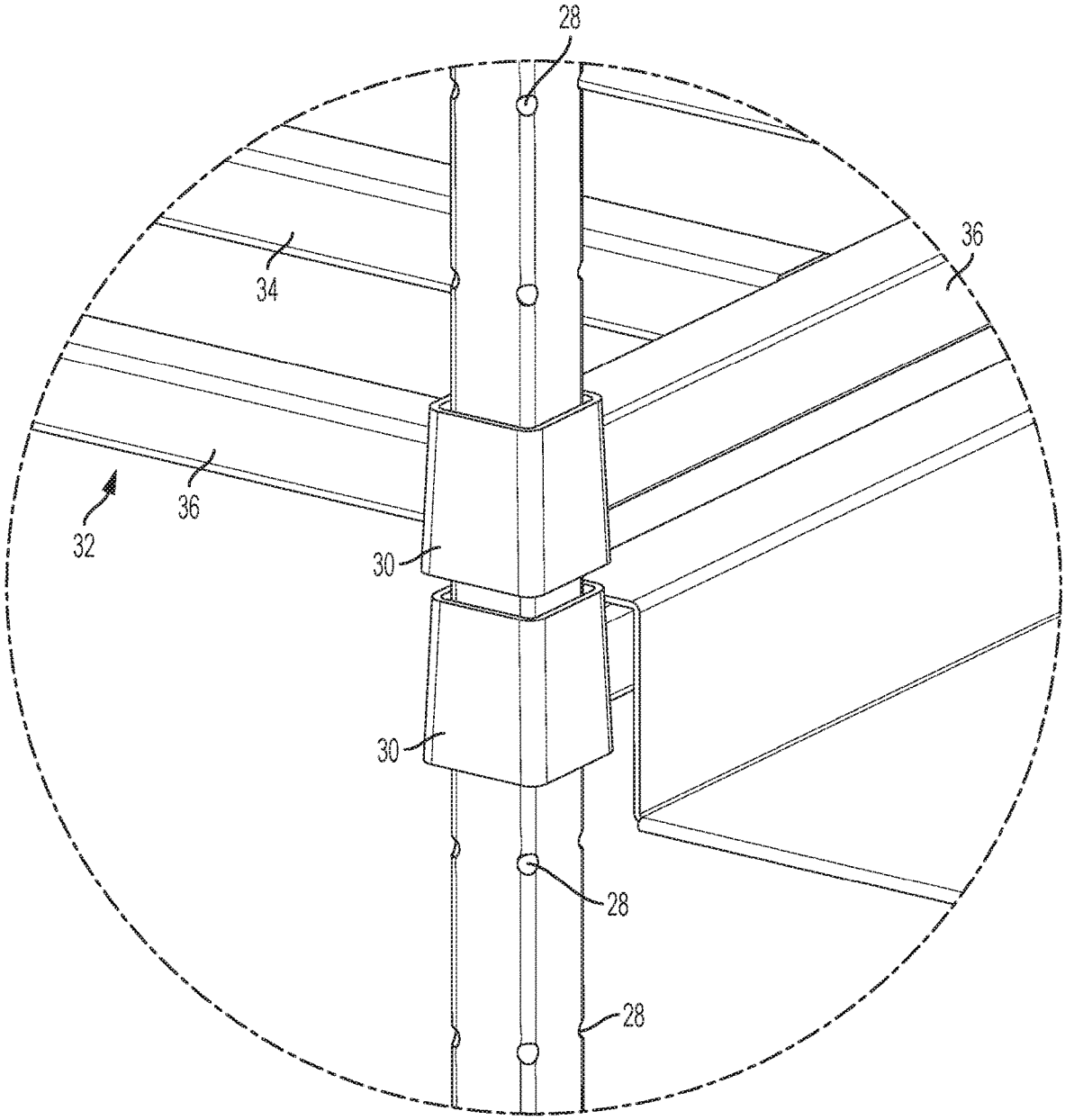
FIG. 2B is an enlarged perspective view of a portion of a vertical leg of the frame.

Referring also to FIG. 2A, the beams or legs 12, which may comprise, e.g., four legs, six legs, eight legs, etc., in total depending on the configuration of the system 10, each have a square cross-section with filleted or chamfered corners and extend between a foot end 24 (at a ground surface) and an upper end 26 (abutting the countertop 18 when the cabinet system 10 is assembled). The legs 12 may alternatively have a rectangular, circular, or other suitable cross-section. As shown in greater detail in FIG. 2B, each leg 12 includes indents 28 spaced at intervals (e.g., one inch intervals) along the length of the leg 12 and positioned at each fillet or chamfer (or otherwise at one or more, but preferably each, of the corners) around the leg perimeter.

Each shelf 14 includes an outer frame portion 32 and an inner support portion 34. The outer frame portion 32 includes a plurality of outer frame members 36 terminating and fixed to connectors 30. Connectors 30 are in the form of tapered collets made of steel, or other suitable materials. The connectors 30 are hollow and include a rectangular interior profile sized to slide over the legs 12 and engage inner nylon collets (not shown) axially fixed to the indents 28 on the legs 12. The inner nylon collets may include two halves that snap into engagement with one another, protrusions within the two halves engaging the indents 28 upon assembly. The inner nylon collets are tapered, allowing the connectors 30 to slidably engage the external profile of the inner collets without allowing further axial translation. Therefore, the connectors 30 are only removable by axial translation upward along the leg 12. As shown, each connector 30 is fixed to two of the outer frame members 36, forming a right angle therebetween. More particularly, the outer frame members 36 include first members 36A defining the depth of the shelf 14 and second members 36B defining the width of the shelf 14. As shown, the second members 36B and the first members 36A collectively form a rectangular sub-frame.

The inner support portion 34 includes cross members 40 spanning the gap defined by the outer frame portion 32. As shown in FIG. 2A, the inner support portion 34 may include members 40 of similar length to the second members 36B to span the width of the gap. Alternatively, or additionally, the inner support portion 34 may include members of similar length to the first members 36A to span the depth of the gap. Further still, as shown in FIG. 2A, the shelf 14 may include a wire frame 42 including rigid wires spanning the gap in one or more directions. Further, crossbeams 38 may span between legs 12 or outer frame members 36 to provide additional structural rigidity while not necessarily functioning as a shelf.

Drawers 16, such as the ones shown in FIG. 1, may be utilized in place of one or more of the shelves 14. For example, as shown, the cabinet system 10 includes two shelves 14 on a left side and four drawers 16 on a right side. The drawers may be attached or coupled to the legs 12, frame members 36, or other crossbeams 38 via a rail system (not shown).

The countertop 18, when assembled, is located above the shelves 14 and legs 12, extending in an upper plane transverse to the lengthwise direction of the legs 12 (i.e., parallel to the shelves 14). The countertop 18 may include first apertures 44 for sinks 46 and second, smaller apertures 48 for electrical lines, water lines, or other utilities. As shown, the countertop 18 overhangs the legs 12 to define a lip 50 on the front and sides of the cabinet system 10. The countertop 18 may, for example, be made of metal (e.g., food-grade stainless steel), plastic, ceramic, wood, concrete, or stone.

Figure 5:
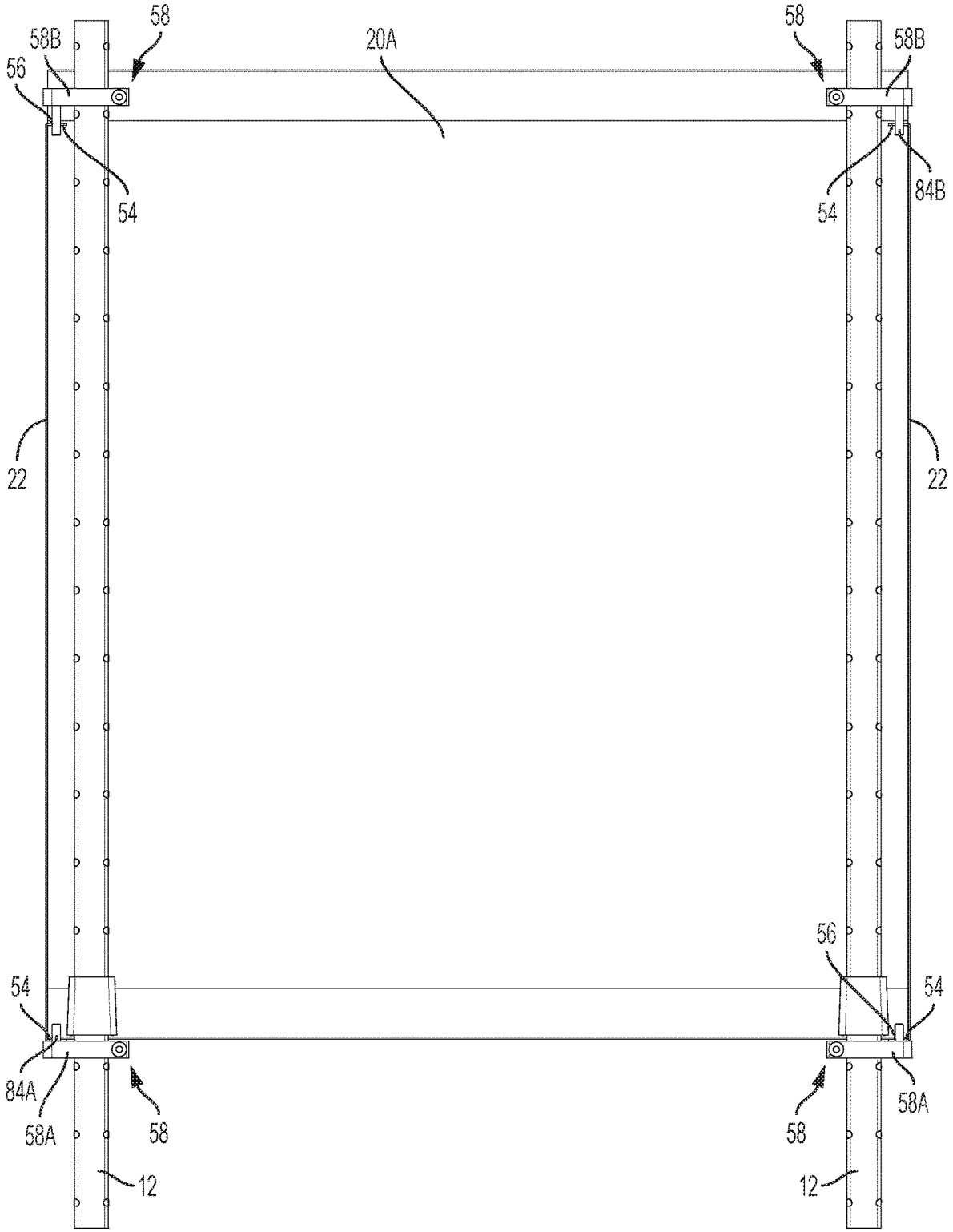
FIG. 5 is an internal front view of a side panel assembly.

Panels 20, such as body panels 20A and door panels 20B, when assembled, are located around the sides of the cabinet system 10 to enclose the shelves 14, and prevent access thereto. The body panels 20A cover an opening defined between two of the legs 12 and prevent access to the interior volume of the shelves 14 through the opening at all times. The body panels 20A may be formed of a single sheet of metal, cut and bent to size. Portions 52 of the body panel 20A may be bent about an edge of the panel 20A to provide additional structural rigidity. As shown, the body panels 20A are rectangular, including four corners, each corner associated with a tab 54 (FIG. 5) extending transverse to the plane of the panel. As shown, the body panel 20 includes side portions 22 extending from the edges of the panel 20 (i.e., bent at ninety degree angles), the side portions 22 each supporting two of the tabs 54. Each tab includes an aperture 56 sized to engage a mounting bracket or post assembly 58, as will be further described below.

Figure 4:
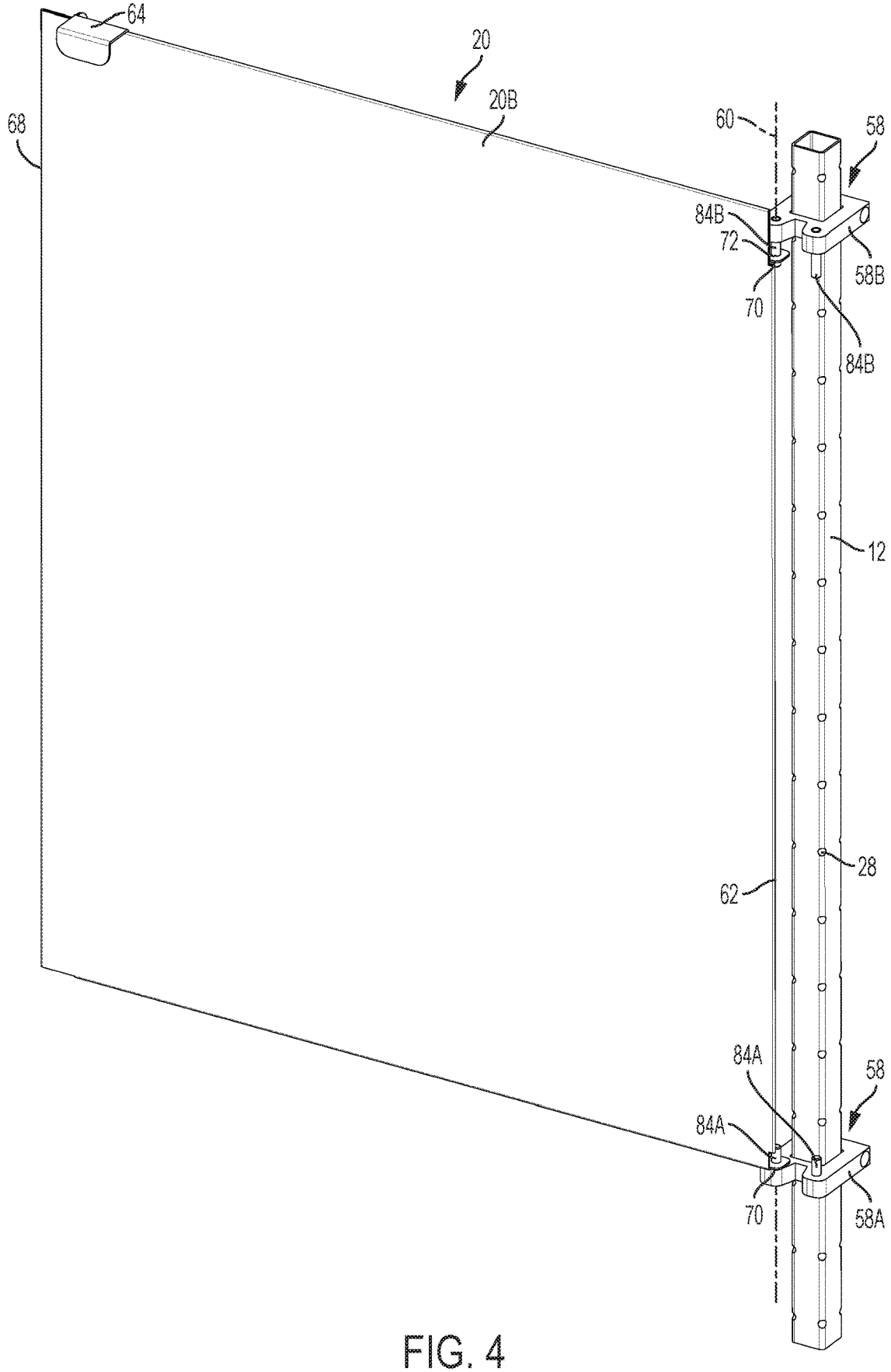
FIG. 4 is a perspective view of a door assembly.

As shown in FIG. 4, the door panels 20B are rotatable about an axis 60 upon assembly between a closed position and an open position such that the door panels 20B hinder access to the shelves 14 when in the closed position, and provide access to the shelves 14 when in the open position. The axis 60 is located adjacent an inside edge 62 of the door panel 20B. The door panels 20B may be formed of a sheet of metal, cut and bent to size. Further, a handle 64 may be fixed to the door panel 20B adjacent an outside edge 68 of the door panel, the outside edge 68 opposite the inside edge 62. Portions 66 of the door panel 20B may be bent about an edge of the door panel 20B to provide additional structural rigidity. As shown, the body panels 20B are rectangular, including four corners, two corners associated with the inside edge 62, the other two corners associated with the outside edge 68. The corners associated with the inside edge 62 each include a tab 70 extending transverse to the plane of the door panel 20B. Each tab 70 includes an aperture 72 sized to engage a mounting bracket or post assembly 58 as described below. Both the body panels 20A and the door panels 20B are supported on the frame 74 of the cabinet system 10 via a plurality of post assemblies 58.

Figure 3A:
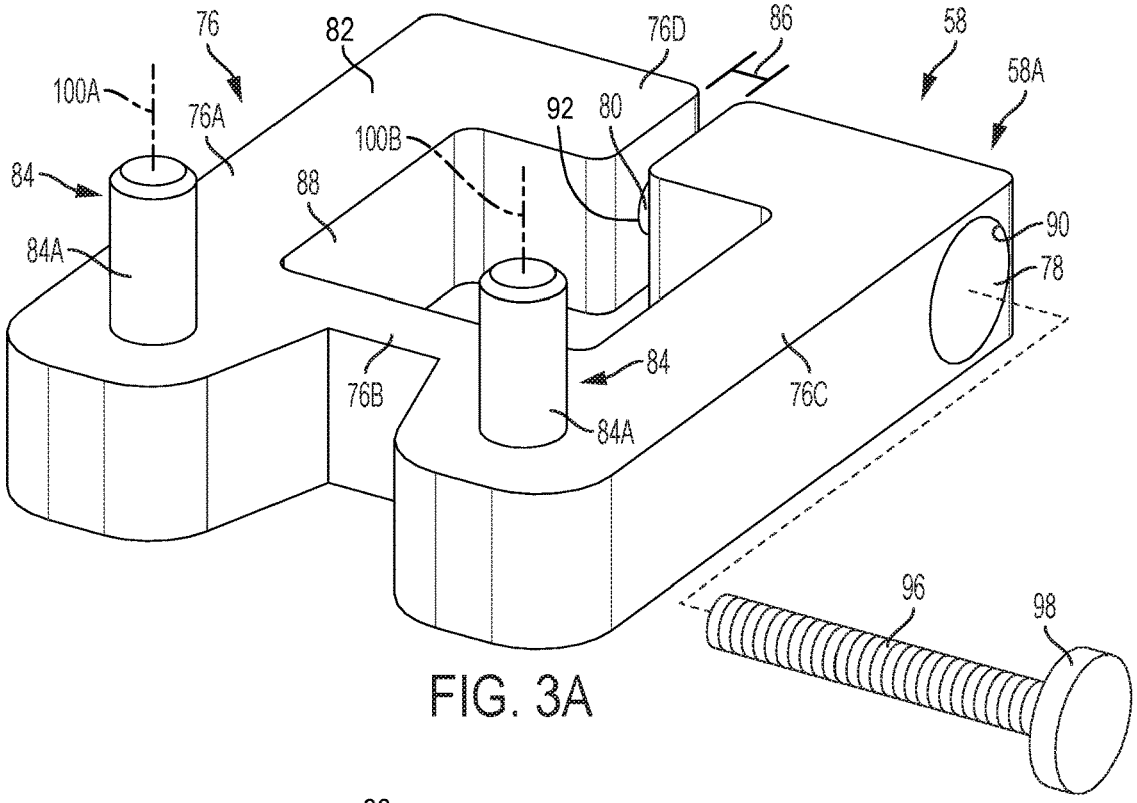
FIG. 3A is a perspective view of a lower post assembly.
Figure 3B:
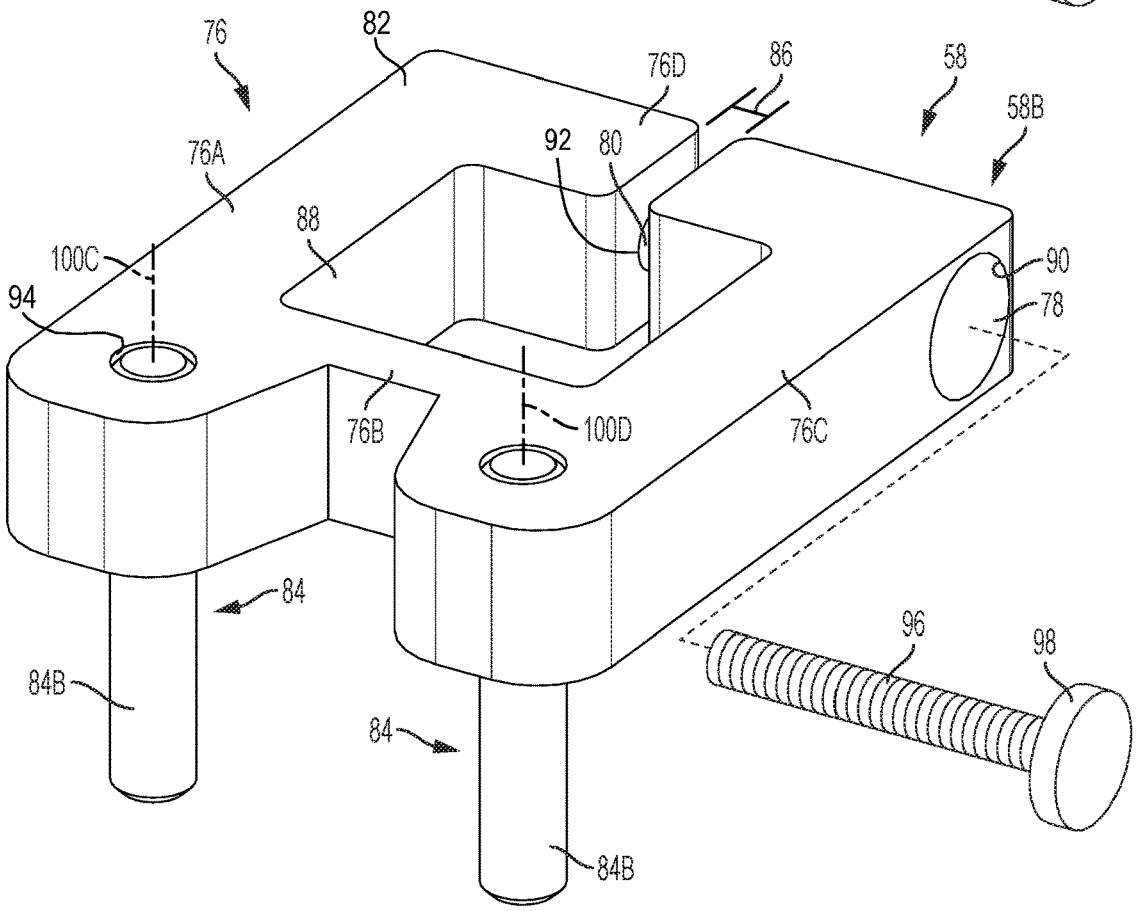
FIG. 3B is a perspective view of an upper post assembly.

As shown in FIGS. 3A-3B, the post assemblies 58 include a bracket 76 and a plurality of extensions or posts 84.

The cross-section of the bracket 76 is generally C-shaped with three complete sides 76A, 76B, 76C and a fourth side 76D, which defines a centered space or discontinuity or gap 86. Sides 76A, 76B, 76C and 76D define an interior opening 88 sized to accommodate an individual leg 12 of the cabinet system 10. Specifically, the opening 88 is configured to receive one of the legs 12 such that the assembly 58 is slidable along the length of the leg 12. Therefore, the post assemblies 58 may include circular, rectangular, or other internal cross-sections to accommodate the cross-sectional shape of the legs 12.

The fourth side 76D of the post assembly 58 further defines two channels 78, 80 axially aligned with one another and extending through each respective portion of fourth side 76D. The first channel 78 includes a first circular opening 90 on side 76C with a first cross-sectional area at a first end and a second circular opening at the gap 86 (not shown) having a cross-sectional area less than the first cross sectional area. The channel 78 abruptly changes in cross-sectional area between the first opening 90 and the second opening and serves as a countersink for a fastener as well as a travel stop. The portion of the channel 78 with the first cross-sectional area may be unthreaded and the portion of the channel 78 with the second cross-sectional area may be threaded.

The second channel 80 includes a circular opening 92 located at the gap 86 and axially aligned with the second circular opening of the first channel 78. The cross-sectional area of the second channel 80 is constant and is similar to the circular cross-sectional area of the adjacent portion of the first channel 78. The second channel 80 may extend axially from the gap 86 through the outside edge of side 76A, or may terminate before reaching the outside edge of side 76A. The second channel 80 may additionally be threaded. Alternatively, the second channel 80 may mirror the first channel 78 (i.e., including two portions, a first larger portion and a second smaller threaded portion) such that the post assembly is mirrored about the gap 86.

A fastener 96 (e.g., screw, bolt) may be threaded into the first and second channels 78, 80. The head 98 of the fastener 96 as assembled is located within the unthreaded portion of the first channel 78 such that it does not protrude outside of the post assembly 58. Alternatively, the channels 78, 80 may be unthreaded, and a nut (not shown) may be used opposite the fastener 96 to secure the fastener 96 relative to the post assembly 58.

The post assemblies 58 further include two posts 84 extending from the bracket 76. The posts 84 are cylindrical and extend at an orientation orthogonal to a surface 82 of the bracket 76. As illustrated in FIG. 3B, the posts 84 are not integral to the bracket 76 but are coupled to the bracket 76 via a recess 94 using a secondary assembly process (e.g., friction welding, interference fit, press fit, adhesive). Alternatively, the posts 84 may be formed integrally with the bracket 76.

The posts 84 of different brackets 76 are of different extension lengths depending upon their final assembly location within the cabinet system 10. As shown in FIG. 3A, "lower" post assemblies 58A include posts 84A that extend up from the surface 82 and are a first length (e.g., 0.75 inches, 1 inch, etc.) along a longitudinal axis 100A, 100B. As shown in FIG. 3B, "upper" post assemblies 58B include posts 84B that extend from the side opposite to surface 82 and are a second length along a longitudinal axis 100C, 100D, in which the second length is longer than the first length (e.g., 0.25 inches longer, 0.5 inches longer, etc.).

Assembling the cabinet system 10 includes assembling the frame assembly 74, attaching the countertop 18, and adding the body and door panels 20A, 20B. The frame assembly 74 is assembled by locating the legs 12 relative to one another and coupling the shelves 14 to the legs 12 by positioning the connectors 30 about the respective legs 12 at a desired height along the legs 12. Specifically, the nylon portion of the connector 30 is placed at the desired height, engaging with the indents 28, and the steel portion of the connector 30 is slid into engagement with the nylon portion. Depending on the structure of the shelf 14, the associated connectors 30 may need to be positioned about the legs 12 concurrently. Drawers 16 are also mounted using a rail system (not shown). As shown in FIG. 1, the countertop 18 is attached to the frame 74 at the legs 12 or the outer frame portion 32 of the shelves 14. The countertop 18 may be attached via adhesive or fasteners (e.g., screws, bolts, etc.). Utility connections in the form of faucets, sinks 46, electrical outlets, etc., may be attached to the countertop 18 before or after assembly to the frame 74. FIG. 2 is but one example of a large number of possible configurations of leg, shelf, and drawer spacing for an assembled cabinet system 10.

Assembling one of the door panels 20B includes positioning two post assemblies 58A, 58B along a respective leg 12, thereby coaxially aligning the respective posts 84A, 84B of the upper and lower post assemblies 58A, 58B. Specifically, one post 84A, 84B from each post assembly 58A, 58B will align with the axis 60 of the door panel 20B adjacent the inside edge 62 when assembled. The post assembly 58A, 58B may be slid over an end of the leg 12 and translated to the desired height. Alternatively, the gap 86 in the bracket 76 may permit elastic deformation of the post assembly 58A, 58B such that the gap 86 widens to the size of the leg 12, allowing for direct positioning of the assembly 58A, 58B at the desired height. Once the assembly 58A, 58B is located at the desired height on the leg 12, the fastener 96 is positioned within the channels 78, 80 and tightened, pulling the second channel 80 towards the first channel 78 and decreasing the size of the gap 86 and consequently the interior opening 88, thereby securing the respective post assembly 58A, 58B relative to the leg 12.

Figure 4B:
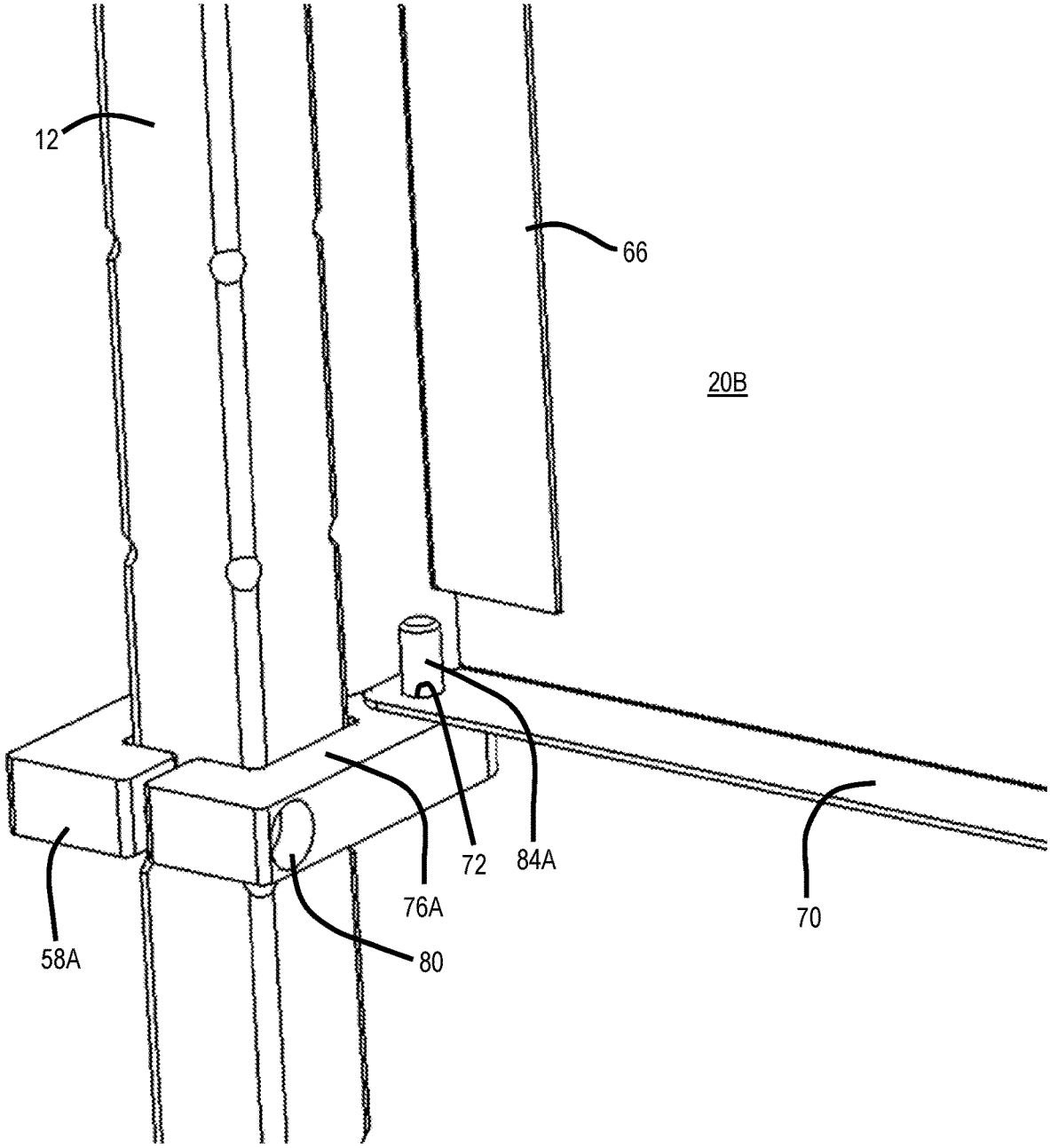
FIG. 4B is an enlarged perspective view of a tab and lower post assembly arrangement of the door assembly of FIG. 4A.

The spacing between the two post assemblies 58A, 58B on a leg 12 permits the assembly of the door panel 20B to the leg 12 without further movement of the post assemblies 58A, 58B. Specifically, after securing assemblies 58A, 58B to a leg 12, the shortest distance between axially aligned posts 84A, 84B is less than the distance between the aligned tabs 70 on the door panel 20B. Therefore, to assemble the door panel 20B to the post assemblies 58A, 58B, the aperture 72 in the upper tab 70 of the panel 20B is slid onto the post 84B of the upper post assembly 58B until the lower tab 70 clears the post 84A in the lower post assembly 58A. As shown in FIG. 4B, the door panel 20B is then lowered onto the post 84A of the lower post assembly 58A, i.e., the aperture 72 in the lower tab 70 is slid onto the post 84A. Since the length of the upper post 84B is greater than the length of the lower post 84A, assembly is completed without moving or adjusting either post assembly 58A, 58B, with each post 84A, 84B extending through one of the apertures 72 and providing support and an axis of rotation (60) for the door panel 20B. In some assemblies, the lower post 84A may be capped to prevent removal of the door panel 20B without first removing the cap.

Assembling one of the body panels 20A includes positioning four post assemblies 58A, 58B, and in particular locating two post assemblies 58A, 58B along one of the legs 12 and locating the other two post assemblies 58A, 58B along another of the legs 12, which coaxially aligning the posts 84A, 84B of the lower and upper post assemblies 58A, 58B. Assembly of the post assemblies 58A, 58B to the legs is carried out in a similar manner to the assembly of the door panels 20B.

Figure 5B:
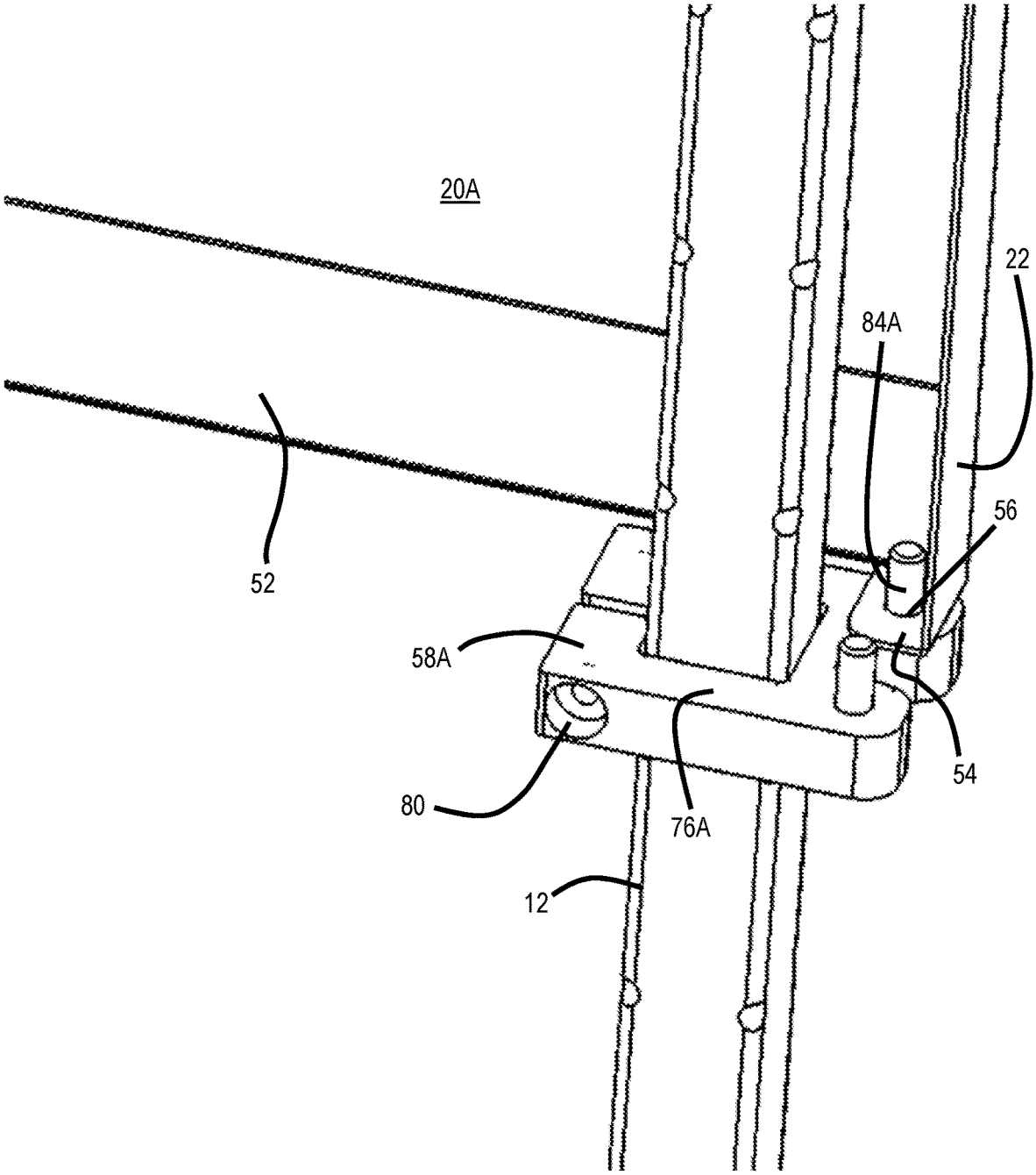
FIG. 5B is an enlarged perspective view of a tab and lower post assembly arrangement of the side panel assembly of FIG. 5A.

The spacing between the upper post assemblies 58B and the lower post assemblies 58A on each leg permits the assembly of the body panel 20A to the post assemblies 58A, 58B without further movement of the post assemblies 58A, 58B. In order to assemble the body panel 20A to the post assemblies 58A, 58B, the aperture 56 in each upper tab 54 is slid onto the posts 84B of the respective upper post assemblies 58B until the lower tabs 54 clear the posts 84A in the lower post assemblies 58A. As shown in FIG. 5B, the body panel 20A is then lowered onto the posts 84A of the lower post assemblies 58A. Similar to the assembly of the door panels 20B to the frame 74, assembly is completed without moving any post assemblies 58A, 58B, and each post 84A, 84B extends through one of the apertures 56, providing support for the body panel 20A and preventing a force transverse to the plane of the body panel 20A from removing the body panel 20A.

If a body panel 20A is located adjacent another body panel 20A or a door panel 20B, the other of the posts 84A, 84B not utilized by the body panel 20A may be used to secure an adjacent panel 20. Therefore, adjacent panels 20 can be located at similar heights. Further, door panels 20B and body panels 20A can be swapped or removed to vary the assembly without removing or moving the post assemblies 58.

Various features of the disclosure are set forth in the following claims.

What is claimed is:

1. A cabinet system comprising:

a frame at least partially defined by a plurality of vertical legs, and a shelf defining a first plane and supported by the plurality of vertical legs, the plurality of vertical legs extending transverse to the first plane;

a countertop supported by the plurality of vertical legs;

a body panel coupled to the frame, wherein the body panel has a plurality of apertures;

a door coupled to the frame and operable to selectively provide access to the shelf, wherein the door has a plurality of apertures; and a plurality of posts coupled to the frame and extending transverse to the first plane, wherein each post of the plurality of posts is configured to extend through (i) an associated aperture of the plurality of apertures in the body panel to couple the body panel to the frame or through (ii) an associated aperture of the plurality of apertures in the door to couple the door to the frame, and wherein four posts of the plurality of posts are coupled to a first vertical leg of the plurality of vertical legs.

2. The cabinet system of claim 1, wherein the door is supported by two posts of the four posts, the two posts coupled to the first leg of the plurality of vertical legs.

3. The cabinet system of claim 2, wherein the two posts of the four posts mounted to the one leg of the plurality of legs are axially aligned.

4. The cabinet system of claim 3, wherein each of the two posts extend along an axial direction, and wherein the two posts of the four posts are of different lengths in the axial direction.

5. The cabinet system of claim 3, wherein the door is rotatable about the two posts of the four posts.

6. The cabinet system of claim 1, wherein the body panel is supported by two posts of the four posts coupled to the first leg of the plurality of vertical legs and is supported by two posts of the plurality of posts mounted to another leg of the plurality of vertical legs.

7. The cabinet system of claim 1, wherein each of the body panel and the door is removable from the frame without prior removal of any post of the plurality of posts from the frame.

8. The cabinet system of claim 1, wherein the plurality of posts includes a first subset of posts coupled to the frame via a first mounting bracket, and a second subset of posts coupled to the frame via a second mounting bracket, wherein the door is coupled to the frame via the first and second mounting brackets and the body panel is coupled to the frame via the first and second mounting brackets.

9. The cabinet system of claim 8, wherein each post of the first subset of posts extends from the first mounting bracket toward the second mounting bracket, and wherein each post of the second subset of posts extends from the second mounting bracket toward the first mounting bracket.

10. The cabinet system of claim 9, wherein the frame is supportable at a foot end upon a support surface, wherein each post of the first subset of posts extend from the first mounting bracket in a downward direction toward the support surface, and wherein each post of the first subset of posts have a greater length in an axial direction than the length of each post of the second subset of posts.

11. The cabinet system of claim 8, wherein both of the first and second mounting brackets encircle one leg of the plurality of vertical legs.

12. The cabinet system of claim 1, wherein at least one of the plurality of posts is configured to be coupled to one of the plurality of vertical legs such that it is spaced apart from the shelf.

13. A cabinet system comprising:

a frame having a plurality of frame members each securable to one another;

first and second mounting brackets, each of which is configured to removably couple to a same one of the plurality of frame members in an assembled state of the cabinet system, wherein each of the first and second mounting brackets includes a pair of spaced-apart posts; and at least two panels each having a first aperture and a second aperture, wherein the pair of spaced-apart posts of the first mounting bracket is configured such that a first post of the pair of spaced-apart posts is positioned in the assembled state of the cabinet system to extend through the first aperture of a first panel of the at least two panels to couple the first panel to the frame and a second post of the pair of spaced-apart posts is positioned in the assembled state of the cabinet system to extend through the first aperture of a second panel of the two panels to couple the second panel to the frame and the pair of spaced-apart posts of the second mounting bracket is configured such that a first post of the pair of the spaced-apart posts is positioned in the assembled state of the cabinet system to extend through the second aperture of the first panel to couple the first panel to the frame and a second post of the pair of spaced-apart posts is positioned in the assembled state of the cabinet system to extend through the second aperture of the second panel to couple the second panel to the frame.

14. The cabinet system of claim 13, wherein the first panel of the at least two panels is a door panel operable to rotate about the posts.

15. The cabinet system of claim 13, wherein the first post of the pair of spaced-apart posts of the first bracket is coaxial with the first post of the pair of spaced-apart posts of the second mounting bracket when the first and second mounting brackets are coupled to the same one of the frame members.

16. The cabinet system of claim 13, wherein each of the first and second mounting brackets is configured to slidably engage the same one of the plurality of frame members.

17. The cabinet system of claim 13, wherein the two posts of each pair of spaced-apart posts of each of the first and second mounting brackets are oriented in a parallel arrangement.

18. The cabinet system of claim 17, wherein the two posts of the pair of spaced-apart posts of the first mounting bracket are of a first length, and wherein the two posts of the pair of spaced-apart posts of the second mounting bracket are of a second length greater than the first length.

19. The cabinet system of claim 13, wherein the same one of the plurality of frame members is a vertical leg, wherein each of the first and second mounting brackets encircles the vertical leg.

20. The cabinet system of claim 13, wherein each of the first and second mounting brackets is C-shaped to define a gap, wherein a first fastener is configured to extend through the gap of the first mounting bracket and a second fastener is configured to extend through the gap of the second mounting bracket.

21. A cabinet system comprising:

a frame having a plurality of frame members each securable to one another;

first and second mounting brackets, each of which is configured to removably couple to a same one of the plurality of frame members, wherein each of the first and second mounting brackets includes a post, wherein the post of the first mounting bracket is coaxial with the post of the second mounting bracket when the first and second mounting brackets are coupled to the same one of the plurality of frame members; and a panel having a first aperture and a second aperture, wherein the post of the first mounting bracket has a first length and is configured to extend through the first aperture and the post of the second mounting bracket has a second length different from the first length and is configured to extend through the second aperture to couple the panel to the frame.

22. A cabinet system comprising:

a frame having a plurality of frame members each securable to one another;

first and second mounting brackets, each of which is configured to removably coupe to one of the frame members, wherein each of the first and second mounting brackets includes a post, and wherein at least one of the plurality of frame members comprises a vertical leg and each of the first and second mounting brackets is configured such that in an assembled state of the cabinet system the first and second mounting brackets each encircle the vertical leg; and a panel having a first aperture and a second aperture, wherein the post of the first mounting bracket is configured to extend through the first aperture and the post of the second mounting bracket is configured to extend through the second aperture to couple the panel to the frame.

* * * * *